US005291093A

United States Patent [19]

Lee

[11] Patent Number: 5,291,093

[45] Date of Patent: Mar. 1, 1994

[54] INLINE TYPE ELECTRON GUN FOR COLOR CATHODE RAY TUBES

[75] Inventor: Sungwoo Lee, Kyunggi, Rep. of Korea

[73] Assignee: Samsung Electron Devices Co., Ltd., Kyunggi, Rep. of Korea

[21] Appl. No.: 834,473

[22] Filed: Feb. 12, 1992

[30] Foreign Application Priority Data

Feb. 12, 1991 [KR] Rep. of Korea ..... 91-2338

[51] Int. Cl.[5] ..... H01J 29/56

[52] U.S. Cl. ..... 313/414; 313/412; 313/425; 313/439; 313/460

[58] Field of Search ..... 313/414, 412, 413, 425, 313/428, 432, 437, 439, 447, 460, 448, 436

[56] References Cited

U.S. PATENT DOCUMENTS 4,362,964 12/1982 Sakurai et al. ..... 313/412 X
4,370,592 1/1983 Hughes et al. ..... 313/414
4,760,308 7/1988 Shirai et al. ..... 313/428 X
4,772,826 9/1988 Bloom et al. ..... 313/412 X
5,015,911 5/1991 Cho ..... 313/447 X

FOREIGN PATENT DOCUMENTS 0013769 2/1979 Japan ..... 313/437

*Primary Examiner*—Donald J. Yusko
*Assistant Examiner*—Ashok Patel
*Attorney, Agent, or Firm*—Christie, Parker & Hale

[57] ABSTRACT

An inline type electron gun has a lopsided electric field applied to it to improve the spot formation of an electron beam in forming an expanded focus lens. The electron gun has first electrode to eighth electrode and has a lopsided electric field formed only at the two side apertures of a trio of apertures formed at one of the opposing sides of the sixth and seventh electrodes before a lopsided main focus lens formed between the seventh and eighth electrodes.

4 Claims, 5 Drawing Sheets

INLINE TYPE ELECTRON GUN FOR COLOR CATHODE RAY TUBES

FIELD OF THE INVENTION

The present invention relates to an inline type electron gun for color cathode ray tubes (CRTs) and, more particularly, to an inline type electron gun having improved picture quality and, at the same time forming an expanded focus lens such that lopsided electric field is applied to apertures for R,G,B (red, green and blue) electron beams formed in a pair of electrodes which form a main focus lens, so that side R,B electron beams are centrally deflected.

BACKGROUND OF THE INVENTION

Color cathode ray tubes are, as shown in FIG. 8, have a bulb 8 formed by uniting a face plate 4 in which a fluorescent layer 2 is formed on the inside surface of a funnel 6. At the inside of a neck portion of bulb 8, there is received an electron gun 10 which emits R,G,B electron beams 12. The beams pass through apertures of a shadow mask 14 and then strike fluorescent layer 2 to form a picture element on a screen. A deflection yoke 16 disposed on the outside surface of the funnel 6 deflects the beams to form the picture on the screen.

The inline type electron gun for such color cathode ray tubes has advantages of being easily manufactured due to the simple structure in which R,G,B electron beams are transversely arranged in a line and omitting vertical dynamic convergence. However, this gun has the disadvantage of having serious spherical aberration of a focus lens for focusing the electron beams.

To reduce spherical aberration, it is well known that greater spacing between a pair of electrodes forming the focus lens creates an expanded focus lens. In this case, the greater the spacing between the pair of electrodes forming the focus lens, the smaller the spherical aberration is. However, when the spacing therebetween is excessively great, static electric charge generated from the periphery of the neck portion has influence on the focus lens to cause the electron beams misconvergence, which severely restricts the expanded focus lens of the inline type electron gun.

Thus, attempts at forming the expanded focus lens have been continued. One of them is described in U.S. Pat. No. 4,370,592 "Color Picture Tube having an Improved Inline electron Gun with an Expanded Focus Lens", issued to Richard H. Hughes on Jan. 25, 1983. FIG. 9 shows the main focus lens structure of the inline type electron gun provided in the U.S. Pat. No. 4,370,592. The electron gun of such method has R,G,B apertures 18R,18G, 18B, 20R, 20G, 20B which are included in a pair of electrodes 18,20, facing each other and has a horizontal lens 22,24 which is formed by deep drawing at a predetermined depth from the opposing side of the two electrodes 18 20 at their peripheries, thereby, in practice, forming the expanded main focus lens without the influence of external static charge. The width of both horizontal lenses 22,24 is, in practice, determined by the lateral width D of the third electrode 18 and by the lateral width E of the fourth electrode 20. While the lateral width D,E is severely restricted by the inside diameter of the neck portion of the color cathode ray tube (CRT), in a practical manufacturing process, it is much restricted by the distance A between the axes of each aperture. That is, while the horizontal lens 22,24 can be used in a SS(small separation) type of 5.08 mm or in a MS(middle separation) type of 5.5-5.6 mm, it can not be used in a LS(large separation) type of more than 6.6 mm.

The reason for not applying the horizontal lens to the LS type will be described as follows. FIG. 10 illustrates n a plan view the fourth electrode 20. Each R,G,B electron beam ER,EG,EB which passes through each aperture 20R,20G,20B thereof is positioned at the center thereof. However, when the distance A between the axes of each aperture is more than 6.6 mm, the respective distance from the two side apertures 20R,20B to the two ends of the horizontal lens 24 become different from each other, whereby each horizontal focusing voltage between the central aperture and the two side apertures is different.

The reason of the horizontal focusing voltage difference above is that the both side apertures 20R, 20B are nearer the electrode 20 than the central aperture 20G, whereby the side apertures have higher potential than the center aperture. For the same reason as above, the two side apertures 20R,20B have a partial or local difference between the horizontal and vertical focusing voltage, whereby the picture element formed on the screen is distorted.

FIG. 11 shows shapes of each electron beam when the expanded focus lens electron gun as described above is used in the LS type. As shown in this figure, a core C and a haro H of spot shape formed on the screen by R,G beams ER,EB are deformed right and left so as to be lopsided and in the spot shape of the center G beams EG, the lateral width is 130% of its vertical height for the core C to be formed in a lengthy ellipse shape, and, at the same time, an haro H is formed in a diamond type.

SUMMARY OF THE INVENTION

In accordance with one embodiment of the present invention, an inline type electron gun has an anisotropic (lopsided) or nonuniform electric field applied to improve a spot formation characteristic of electron beams in forming an expanded focus lens of the inline type electron gun.

To achieve this, a multi focusing type inline electron gun comprising first electrode to the eighth electrodes and has a lopsided electric field formed only at two side apertures of the three apertures formed at the opposing side of the sixth and seventh electrodes which precedes a lopsided main focus lens formed between the seventh and eighth electrode.

BRIEF DESCRIPTION OF THE DRAWINGS

Further advantages and other features of the present invention will be apparent in the following detailed description in connection with the accompanying drawings, in which.

DETAILED DESCRIPTION OF THE PREFERRED EMBODIMENT

Figure 1:
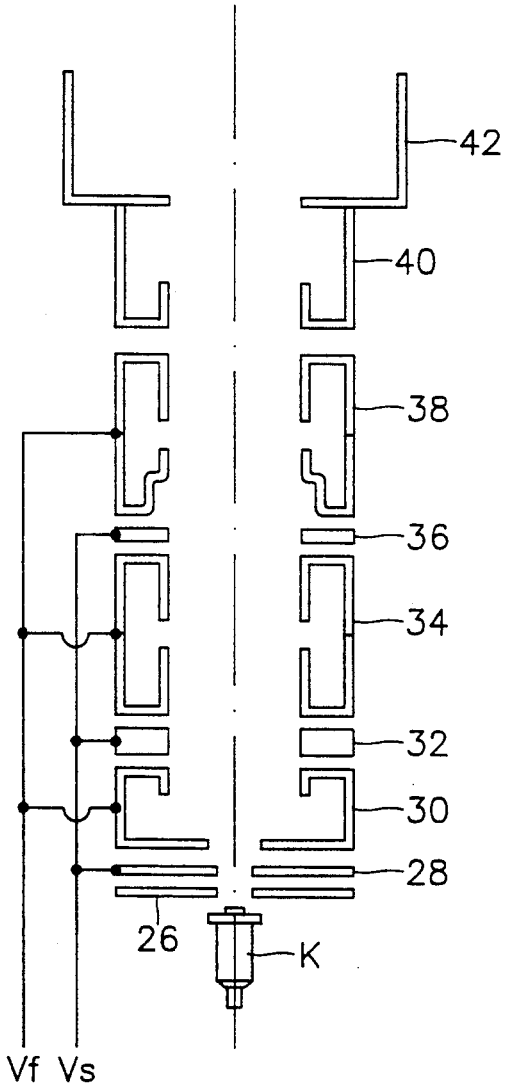
FIG. 1 is a schematic view of electrode arrangement and a wire connection of an inline type electron gun of the present invention.

FIG. 1 illustrates an electrode arrangement and a wire connection of an inline electron gun of the present invention. Such an inline type electron gun is formed by arranging successively a cathode K, first electrode to eighth electrodes 26 to 40 respectively, and a shield cup 42, all at a predetermined distance.

0–1 Kv screen voltage Vs is applied to the second, fourth and sixth electrode 28, 32, 36; a focus voltage Vf of 0–10 Kv is applied to the third, fifth and seventh electrodes 30, 34, 38; a voltage of 0–100 Kv is applied to the remaining first electrode 26; and 0–30 Kv high voltage is applied to the eighth electrode 40 and the shield cup 42.

The wire connection of the third, fourth and fifth electrode 30, 32, 34 forms a first unipotential lens, that of the fifth, sixth and seventh electrode 34, 36, 38 forms a second unipotential lens, and that of the seventh and eighth electrode 38, 40 forms a bipotential lens, so that a main focus lens of such electron gun is a uni-uni-bipotential lens.

Figure 2A:
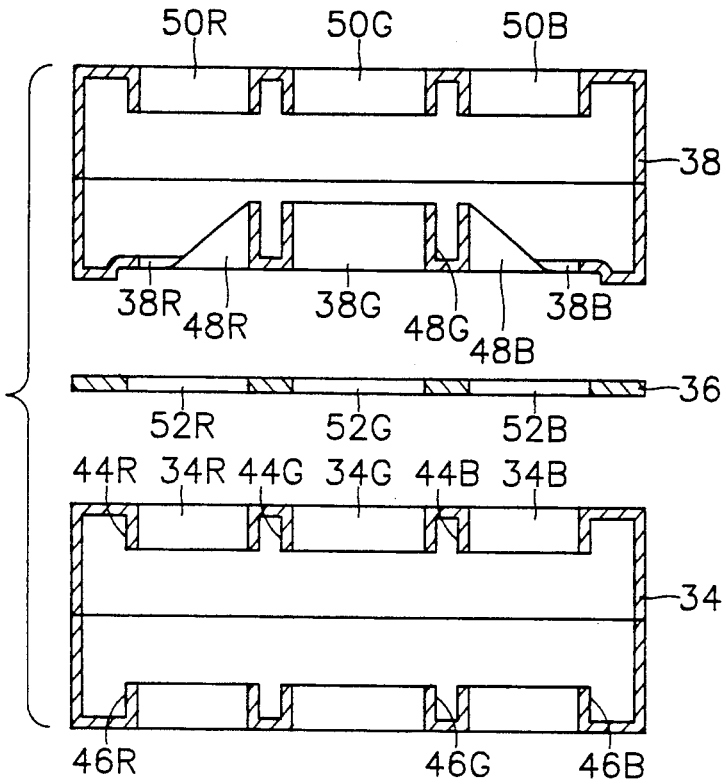
FIG. 2A is a sectional side view of the fifth electrode to the seventh electrode arrangement of FIG. 1.
Figure 2B:
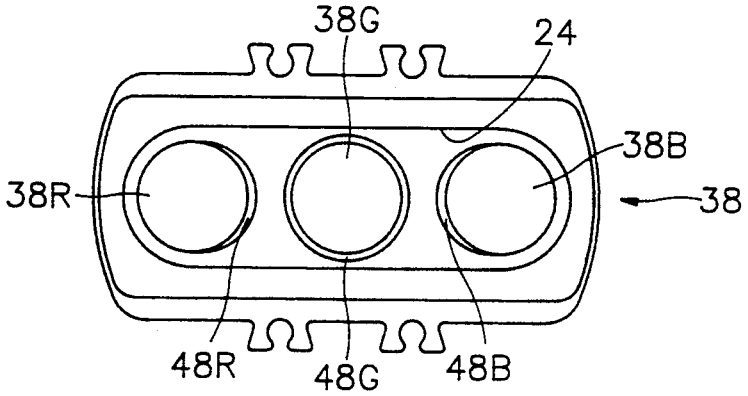
FIG. 2B is a plan view of FIG. 2A.

In the inline type electron gun as described above, the seventh electrode structure 38 is improved as shown in FIGS. 2A and 2B.

FIG. 2A is a sectional side view of the fifth electrode 34 to the seventh electrode 38 arrangement structure. FIG. 2B is a plan view of FIG. 2A. The opposing side of the fifth electrode 34 facing the flat sixth electrode 36 is provided with three apertures 34R,34G,34B. Sleeves 44R,44G,44B are formed in the same type so as to extend at the rime of these apertures 34R,34G,34B.

Such fifth electrode 34 is formed in a cup-shaped electrode structure which has sleeves 46R,46G,46B of the same type at a symmetrical position to the three sleeves 44R,44G,44B.

Figure 3:
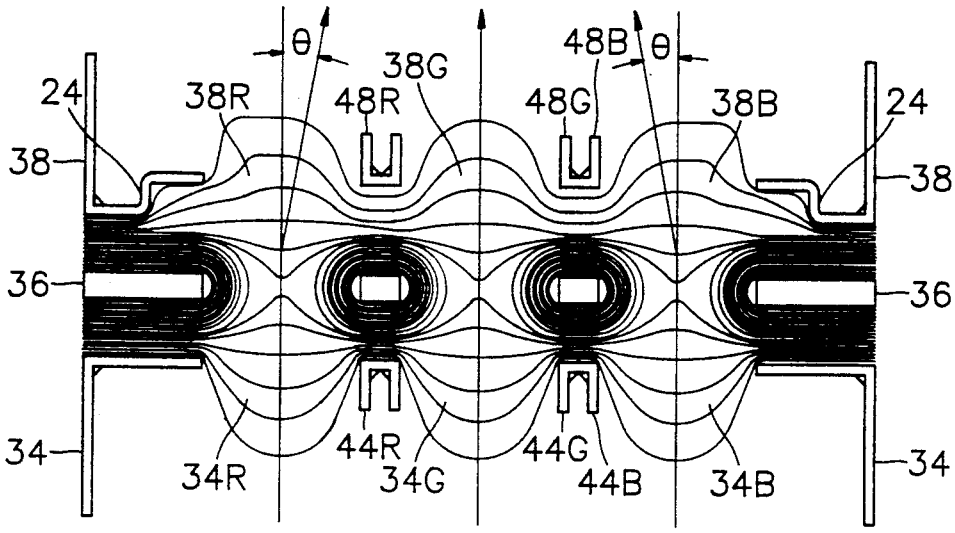
FIG. 3 is a schematic view of distribution of equipotential formed at the electrodes of FIG. 2A.

Also the opposing side of the seventh electrode 38 facing the sixth electrode 36 is provided with three apertures 38R, 38G, 38B of which a center aperture 38G, for passing through G beam is provided with a sleeve 48G at its rim. Bulkheads 48R,48B are provided adjacent of the above sleeve 48G at the rim of the side apertures 38R,38B. Each aperture 34R,34G,34B, 52R,52G,52B and 38R,38G,38B of the fifth, sixth, and seventh electrodes 34,36,38 are coaxially arranged. A distribution of equipotential of a corresponding part in the electron gun of FIG. 2A is shown in FIG. 3. In this case, since a left and right symmetrical expanded focus lens is formed in the center aperture 38G of the seventh electrode 38, the G electron beam passes straight therethrough. However, since the R,B beams which pass through the side apertures 38R,38B pass through lopsided, focus lenses formed under the influence of electric field due to the bulkheads 48R,48B, each R,B beams is deflected at an angle 0 toward the center G beam, as shown in FIG. 3.

Figure 4:
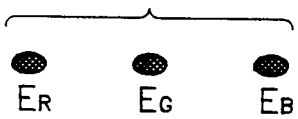
FIG. 4 is a view of an embodiment of a spot formation of the electron beam of FIG. 2A.

Accordingly, the shapes of all the R,G,B beams formed on a screen are changed in a nearly uniform way, as shown in FIG. 4. Namely, before passing through a conventional main focus, lens formed between the seventh 38 and eighth electrode 40 in the electron gun of the present invention, the center of the both side R, B beams ER,EB, is deflected, as shown in FIG. 5, by the lopsided focus lens formed by the bulkheads 48R,48B in the apertures 38R,38B of the seventh electrode 38.

Figure 5:
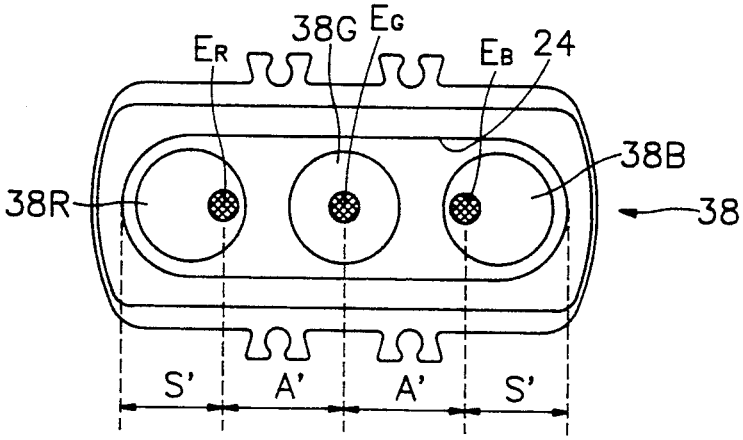
FIG. 5 is a plan view of the central deflection of side R,B beams in the present invention.
Figure 10:
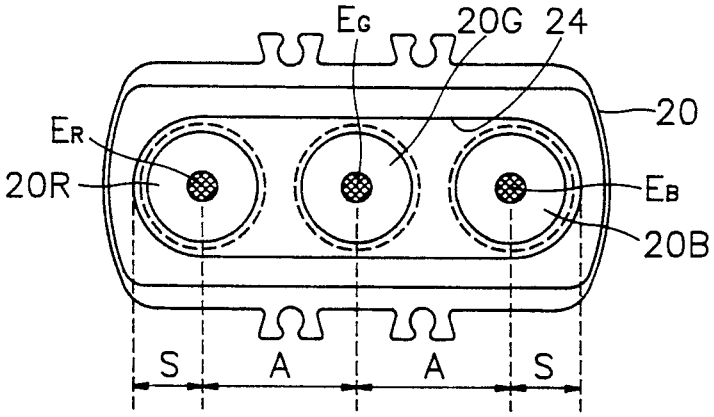
FIG. 10 (Prior Art)
FIG. 10 is a plan view corresponding a structure of FIG. 5, showing the center of electron beams passing through each aperture of FIG. 9.
Figure 11:
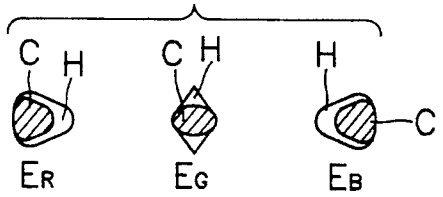
FIG. 11 (Prior Art)
FIG. 11 is a view of a spot formation state of each electron beam of a method used with FIG. 9.

While, with reference to FIG. 10 for explaining a conventional method, the center of each beam aperture agrees with the position through which the beam passes, the R,G beams for passing through the both side apertures in FIG. 5 of the present invention are centrally deflected, deflected toward the center beam. In a conventional electron gun, while the distance between the axes of each electron beam agrees with the distance A between the axes of each aperture, in the present invention, that is not so. That is, when, in the present invention, the distance between the axes of the electron beams is represented as A', the distance from an external side end to the center axis of the both side beams is represented as S', the relationship therebetween is represented as $S' > S$ and $A' < A$ ( where S is the distance from an external side end to the center axis of both side beams of a conventional gun, and A is the distance between the axes of the electron beams of a conventional gun).

Accordingly, an effect of the electron gun of the present invention is to improve resolution of the screen by changing the section of the three beams into a nearly uniform shape in such a manner that the R,B beams are centrally deflected before the R,G beams enter into the lopsided focus lens.

The present invention is not restricted to the embodiment as described above. Whenever the focus lens is formed by a lopsided electric field preceding the lopsided focus lens formed between the seventh electrode 38 and the eighth electrode 40, the same effect as that of the present invention of the above-identified embodiment can be obtained.

Figure 6:
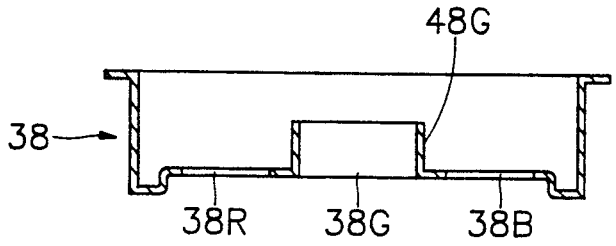
FIG. 6 is a sectional side view of the seventh electrode of another embodiment of the present invention.
Figure 7:
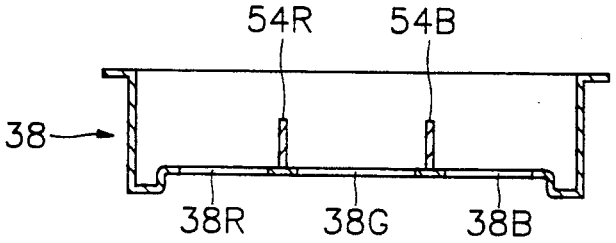
FIG. 7 is a sectional side view of the seventh electrode of a further embodiment of the present invention.
Figure 8:
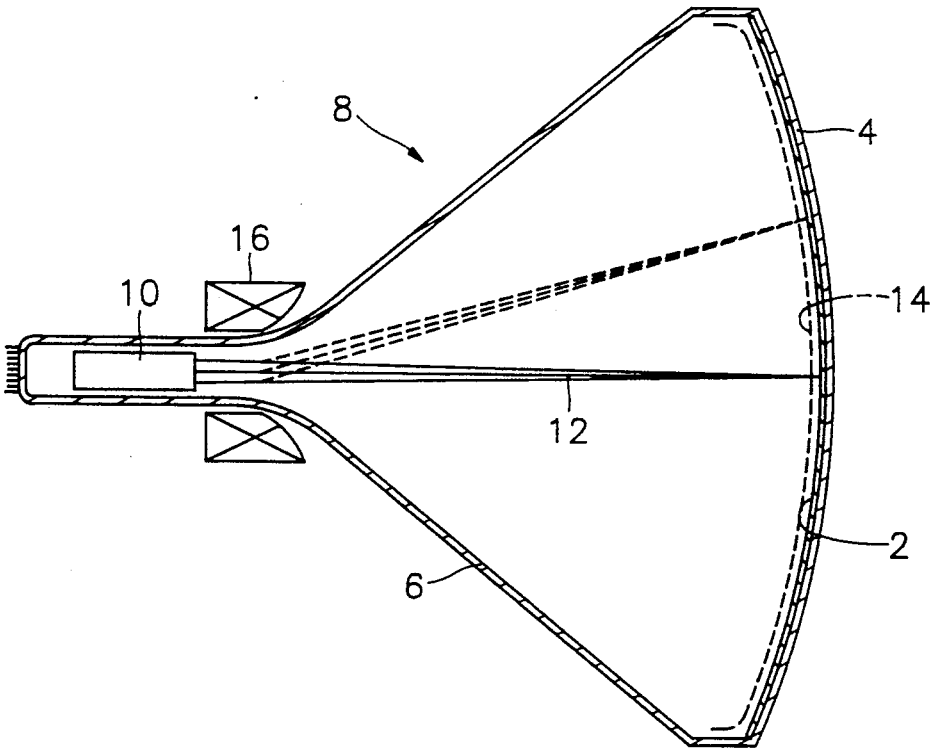
FIG. 8 (Prior Art)
FIG. 8 is a schematic view of a conventional color cathode ray tube structure.
Figure 9:
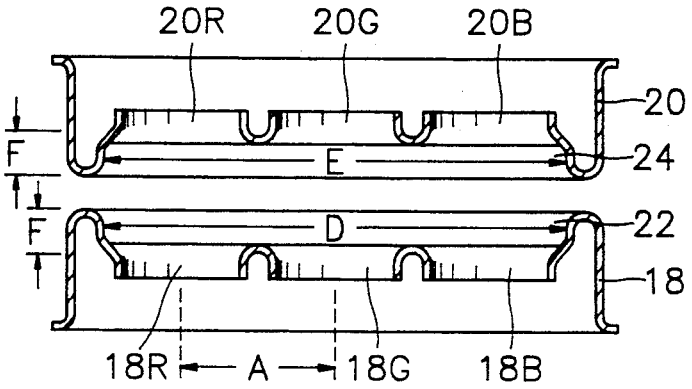
FIG. 9 (Prior Art)
FIG. 9 is a schematic side view of a conventional expanded main focus lens.

An embodiment of FIG. 6 shows a structure in which the sleeve 48G is formed to be extended in the center aperture 38G at the opposing side of the seventh electrode 38 which faces the sixth electrode 36. In accordance with such structure, an electric field formed by the sleeve 48G of the center aperture 38G an influence at the peripheral portion of the side apertures 38R,38B. Another embodiment is shown in FIG. 7 where the bulkheads 54R,54B are installed between the center aperture 38G and the side apertures 38R,38B in the opposing side of the seventh electrode 38 which faces the sixth electrode 36. Such bulkheads 54R,54B are preferably welded as additional components.

The present inventive concept is applicable to other electron guns, as well as the multi-focusing type inline electron gun of the present invention.

What is claimed is:

1. In an inline type electron gun having an electrode assembly for focusing electron beams on a screen of a cathode ray tube, the assembly comprising first through eighth electrodes in order starting from a cathode, which cathode emits the electron beams, the third, fourth, and fifth electrodes forming a first unipotential lens, the fifth, sixth, and seventh electrodes forming a second unipotential lens, and the seventh and eighth electrodes forming a bipotential focusing lens, wherein the fifth, sixth, and seventh electrodes each have a central aperture and two lateral apertures formed therein, the central aperture of each of the fifth, sixth, and seventh electrodes being aligned and respective lateral apertures of each of the fifth, sixth, and seventh electrodes being aligned, the improvement wherein the seventh electrode comprises electric field biasing means for forming an anisotropic electric field at the two lateral apertures thereof to deflect the electron beams passing therethrough toward the central electron beam passing through the central aperture thereof, before the electron beams enter the bipotential focusing lens, and wherein the central aperture and the two lateral apertures in the seventh electrode are formed at a face which opposes the sixth electrode.

2. The electron gun of claim 1, wherein the central aperture of the seventh electrode has a sleeve therearound, and the electric field biasing means comprises bulkheads formed at the lateral apertures of the seventh electrode and disposed on only one side of the axis of each of the two lateral apertures thereof adjacent to the sleeve.

3. The electron gun of claim 1, wherein the central aperture of the seventh electrode has a sleeve therearound.

4. The electron gun of claim 1, wherein each of the lateral and central apertures of the seventh electrode are formed at the side opposing the sixth electrode, and the electric field biasing means comprises bulkheads formed adjacent the lateral apertures, respectively.

* * * * *